US007775304B2

(12) United States Patent
Luo

(10) Patent No.: US 7,775,304 B2
(45) Date of Patent: Aug. 17, 2010

(54) APPARATUS AND METHOD FOR DRIVING CASING OR CONDUCTOR PIPE

(75) Inventor: Yuejin Luo, Middlesex (GB)

(73) Assignee: BP Exploration Operating Company Limited, Middlesex (GB)

( * ) Notice: Subject to any disclaimer, the term of this patent is extended or adjusted under 35 U.S.C. 154(b) by 170 days.

(21) Appl. No.: 11/920,871

(22) PCT Filed: May 9, 2006

(86) PCT No.: PCT/GB2006/001692

§ 371 (c)(1),
(2), (4) Date: Nov. 21, 2007

(87) PCT Pub. No.: WO2006/125948

PCT Pub. Date: Nov. 30, 2006

(65) Prior Publication Data

US 2009/0078466 A1 Mar. 26, 2009

(30) Foreign Application Priority Data

May 25, 2005 (GB) ..... 0510670.3

(51) Int. Cl.
*E21B 10/00* (2006.01)
*E21B 7/18* (2006.01)

(52) U.S. Cl. ..... 175/405; 175/424; 173/76; 173/80; 405/248

(58) Field of Classification Search ..... 175/405, 175/424; 173/76; 405/231, 232, 248, 249, 405/253

See application file for complete search history.

(56) References Cited

U.S. PATENT DOCUMENTS 3,151,687 A * 10/1964 Sato et al. ..... 175/21
3,376,922 A 4/1968 Leonhardt
4,474,243 A * 10/1984 Gaines ..... 166/335
4,702,325 A 10/1987 Hipp

FOREIGN PATENT DOCUMENTS

DE 42 17 293 11/1992

(Continued)

OTHER PUBLICATIONS

Evans, T.G., et al; "Axial Capacities of Jetted Well Conductors in Angola"; *Final*; pp. 1-16; Sep. 11, 2002.

(Continued)

*Primary Examiner*—David J Bagnell
*Assistant Examiner*—Catherine Loikith
(74) *Attorney, Agent, or Firm*—Nixon & Vanderhye

(57) ABSTRACT

Apparatus for driving an open-ended conductor pipe into the ground. The apparatus includes, in combination, an open-ended conductor pipe capable of being driven into the ground, a drill string, a device for pumping fluid through the drill string, an arrangement for supporting the conductor pipe on the drill string, and a reciprocable impact driver supportable by the drill string within the conductor pipe. The apparatus further includes a device for reciprocating the reciprocable impact driver using fluid pumped through the drill string, an anvil capable of transferring the percussive force of the reciprocable impact driver to the conductor pipe, and jets for jetting fluid into the lower portion of the conductor pipe.

11 Claims, 2 Drawing Sheets

FOREIGN PATENT DOCUMENTS

| | | |
|---|---|---|
| GB | 1 429 312 | 3/1976 |
| GB | 2 165 283 A | 4/1986 |
| GB | 2 358 036 | 7/2001 |
| WO | WO 2004/001180 | 12/2003 |
| WO | WO 2004/051004 | 6/2004 |

OTHER PUBLICATIONS

Jeanjean, Philippe; "Innovative Design Method for Deepwater Surface Casings"; *Society of Petroleum Engineers*; SPE 77357; BP America Inc.; pp. 1-14 (2002).

Van Foeken, R.J., et al; "Bottom driving casing technique predictions with TNOWAVE"; *IHC Foundation Equipment*; pp. 1-12.

Article from Scandinavian Oil & Gas Magazine No. 7/8 2004; "World's First Subsea Toe-Driven Conductor Installation"; p. 109.

International Search Report mailed Jun. 13, 2006.

PCT Written Opinion of the International Searching Authority dated Jun. 13, 2006.

PCT Demand.

PCT Notification of Receipt of Demand mailed Jan. 8, 2007.

Response to Written Opinion of the ISA dated Mar. 2, 2007.

PCT International Report on Patentability completed Jun. 25, 2007.

* cited by examiner

APPARATUS AND METHOD FOR DRIVING CASING OR CONDUCTOR PIPE

This application is the U.S. national phase of International Application No. PCT/GB2006/001692 filed 9 May 2006 which designated the U.S. and claims priority to GB 0510670.3 filed 25 May 2005, the entire contents of each of which are hereby incorporated by reference.

The present invention relates to apparatus and method for driving casing, piles or conductor pipe. In particular, the invention relates to apparatus and method for driving conductor pipes that are commonly installed in the hydrocarbon production industry during the construction of oil wells and gas wells, more particularly offshore wells.

BACKGROUND OF THE INVENTION

It is well known in the hydrocarbon production industry to line wells with a number of concentric tubes to stabilise the bores and reduce the risk of fracture of the formation while drilling with weighted mud. The top section of the well casing is generally known as the conductor pipe or conductor or sometimes as the structural casing. This conductor is essentially the well foundation and has different functions throughout its life. The main requirements of the conductor are to:

(1) Stabilize and protect the near-surface sediments during the initial top-hole drilling operations by preventing well bore collapse and fracture of the formation by mud pressures.

(2) Temporarily support the weight of the next section of casing string, usually known as the surface casing.

(3) Act together with the cemented surface casing to resist temporary axial tensile loads, shear loads and bending moments transmitted from the riser through the Blowout Preventer (BOP) while drilling the remaining sections of well.

(4) Act together with the surface casing to resist longer term operational loads from well trees, production risers and other production facilities.

Onshore, or in shallow water, the conductor may be driven into the ground using piling techniques. However, it can be difficult to pile drive a conductor through a relatively thick or deep layer of sand. Installing conductor in deep water presents additional difficulties. One method that has been proposed uses "toe-driving" of the conductor. In this method, the casing is driven into the soil by the impact of a hammer acting at the bottom or toe of the pile compared to driving with a hammer striking at the top of the pile. In one example, a specially designed tip comprises an anvil and a conical penetrating tip. The hydraulic hammer, arranged inside the casing, hits the anvil and drives the conical tip into the soil. The casing is attached to the tip not rigidly but by a shock absorbing element which acts to pull the casing into the soil after the tip. The toe driving method has not been widely used for deep water applications as it can be difficult to achieve deep penetration.

The installation of conductors in deep water usually comprises forming an oversize hole by drilling and then cementing the conductor in place or by jetting, a procedure similar to wash boring in onshore geotechnical investigations. Although the drill and cement process is widely used in relatively shallow water, the soil in deepwater can be relatively weak. Consequently, there is a tendency for the drilled hole to be filled up by soil collapsing from the sides, not only while drilling is being carried out, but also when the drillstring is pulled out for running in casing. Therefore, jetting has been the more commonly used method for deep water.

Jetting is often preferred as it may be quicker and, when performed properly, more reliable than drilling and cementing in normally consolidated clay sediments. However, if not properly planned and executed, jetting may result in excessive delays and even abandonment of a well. One of the greatest risks is excessive disturbance and wetting of the soil that results in low axial capacity and excessive settlement of the conductor when the surface casing is landed on it.

In a conventional jetting method a drill pipe is run inside a length of conductor and locked to the conductor by a drill-ahead running tool. The section of drill pipe inside the conductor, generally called the bottom hole assembly may typically comprise a drill bit positioned close to the lower end of the conductor, a mud motor, measurement-while-drilling directional sensors and a series of heavy drill collars with spacers. The assembly is lowered to the seabed and the conductor is washed into place with seawater and high viscosity mud sweeps injected through the drill bit. The pressurised fluid erodes the soil inside the conductor and around the lower edge and flushes the cuttings up the annular space between the conductor and bottom hole assembly. The resulting reduced soil resistance allows the jet assembly to penetrate the seabed under the combined weight of the conductor and bottom hole assembly. If this weight is insufficient to overcome the frictional resistance, the conductor may be worked up and down (reciprocated) by several metres to wet and remould the surface of the borehole.

As the outside surface of the conductor is in direct contact with the surrounding soil throughout the installation, there may be no need for a cementing operation with jetting. The installation of the conductor relies on the surrounding soil collapsing around the outside of the conductor to support the weight of the conductor and subsequent casing strings. Often jetting is only possible to a relatively shallow depth, typically around 80 metres below mud line, as beyond this, the soil may not collapse around the conductor sufficiently to provide the required support or may take an unacceptably long time to do so. Another potential problem of the known jetting processes is that if the soil does not sufficiently consolidate around the conductor, it may not provide adequate formation isolation. This can be important when shallow formation is warmed up during subsequent drilling or production and hydrate gasifies and rises through the weak soil around the conductor to the seabed, possibly further weakening the soil and reducing its load bearing capacity.

SUMMARY OF THE INVENTION

The present invention overcomes or at least mitigates problems of the known techniques for driving open-ended casing, piles or conductor pipe. Although particularly useful for installing conductor pipe and more specifically for installing conductor pipe in deep water, the invention has wider application to driving tubular elements into the ground and the use in this specification of the terms "conductor" or "conductor pipe" is intended to embrace such wider applications.

It is also anticipated that significant savings in time and cost are achievable by use of the process and apparatus according to the present invention as compared with the conventional method of drilling and cementing the string.

According to a first aspect of the present invention, apparatus for driving conductor pipe into the ground comprises in combination:

(a) a conductor pipe capable of being driven into the ground (b) a drill string (c) means for pumping fluid through the drill string (d) means for supporting the conductor pipe on the drill string (e) a reciprocable impact driving means supportable by the drill string within the conductor pipe (f) means for reciprocating the reciprocable impact driving means using fluid pumped through the drill string (g) an anvil capable of transferring the percussive force of the reciprocable impact driving means to the conductor pipe and (h) means for jetting fluid into the lower portion of the conductor pipe.

The means for pumping fluid through the drill string can conveniently be mud pumps such as those conventionally present on drilling rigs which are used to circulate drilling muds down through the drill string and back through the annulus between the drill string and the well bore or vice versa. The use of the conventional drill string and mud pumps in the present invention simplifies the operation and minimises the disruption to rig activities.

The reciprocable impact driving means can be a hydraulic hammer similar to those already known for driving piles or hard rock drilling. A hammer suitable for use in relatively deep water would typically be able to provide an impact of about 100 to 250 kJ. For shallower water a less powerful hammer may be suitable, for example, a hammer capable of providing an impact of about 30 to 100 kJ. The means for reciprocating the impact driving means is actuated by the fluid pumped through the drill string. The use of fluid pumped through the drill string obviates the need for separate hydraulic lines to drive the hammer.

The reciprocable driving means impacts an anvil which is capable of transferring the percussive force of the reciprocable driving means to the conductor pipe. Suitably, the conductor pipe has an internal shoulder engageable with the anvil.

Suitable means for supporting the conductor pipe on the drill string and the means for supporting the reciprocable impact driving means are known. The conductor pipe and/or the reciprocable impact driving means can be directly or indirectly supported by the drill string.

Preferably, the apparatus further comprises shock absorbing means for reducing the percussive force transmitted between the conductor pipe and the drill string. For example, a shock absorber can be included in the drill string above the means for attaching the conductor pipe to the drill string. In this way the forces resulting from the impact of the driving means are not fully transmitted to the whole drill string.

The means for jetting fluid into the lower portion of the conductor pipe comprises a tubular element in fluid communication with either or both of the drill string and the reciprocal impact driving means; the tubular element having holes through which relatively high pressure fluid can pass into the lower portion of the conductor pipe. Preferably, the means for jetting fluid is arranged such that the jets are directed substantially wholly within the conductor. Thus, for example, the jets may be directed radially towards the inner wall of the conductor pipe and more preferable are directed substantially perpendicularly towards the inner wall of the conductor, for example up to 20 degrees above or below the horizontal plane. Preferably the jets are directed up to 15 degrees below the horizontal plane.

Optionally, a means for breaking up the soil disturbed by the fluid jets may be provided, such as, for example, at least one rotatable blade. Preferably the means for breaking up the soil is positioned adjacent the means for jetting fluid into the lower portion of the conductor pipe. For example, the jetting sub may have at least one rotatable blade that can break up the soil as it is disturbed by the fluid jets. This will facilitate removal of the soil. The rotatable blades could be provided with a separate power source to rotate them, e.g. an electric or hydraulic motor. Preferably, the rotatable blades are driven by fluid flowing through the drill string.

Although the fluid jets are the primary method for removing the soil from within the conductor pipe, this may be supplemented by the use of another drilling device. For example, a conventional rotatable drill bit driven by a downhole motor may be used to drill into the soil to facilitate the action of the fluid jets.

According to a second aspect of the invention, a method for driving conductor pipe into the ground comprises:

(a) assembling at the lower end of a drill string (i) means for supporting a conductor pipe on the drill string, (ii) a reciprocable impact driving means, (iii) means for reciprocating the reciprocable impact driving means using fluid pumped through the drill string, (iv) an anvil capable of transferring the percussive force of the reciprocable impact driving means to the conductor pipe and (v) means for jetting fluid (b) positioning the assembly within a conductor such that the assembly and conductor are supportable by the drill string and the means for jetting fluid is at the lower end of the conductor (c) positioning the lower end of the conductor pipe on the ground into which it is to be driven (d) actuating the reciprocable impact driving means to impact the anvil and drive the conductor pipe into the ground (e) simultaneously or sequentially jetting fluid into the lower part of the conductor pipe such that it flows upwardly carrying with it particles that have been forced into the conductor pipe the fluid and particles being removed from the upper part of the conductor pipe.

According to a third aspect of the present invention, a downhole assembly for use in the present invention comprises, attached at the lower end of a drill string, (i) means for supporting a conductor pipe on the drill string, (ii) a reciprocable impact driving means, (iii) means for reciprocating the reciprocable impact driving means using fluid pumped through the drill string, (iv) an anvil capable of transferring the percussive force of the reciprocable impact driving means to the conductor pipe and (v) means for jetting fluid.

BRIEF DESCRIPTION OF THE DRAWING

The present invention will be described, by way of example, with respect to the accompanying drawings, in which.

DETAILED DESCRIPTION OF PREFERRED EMBODIMENTS

Figure 1:
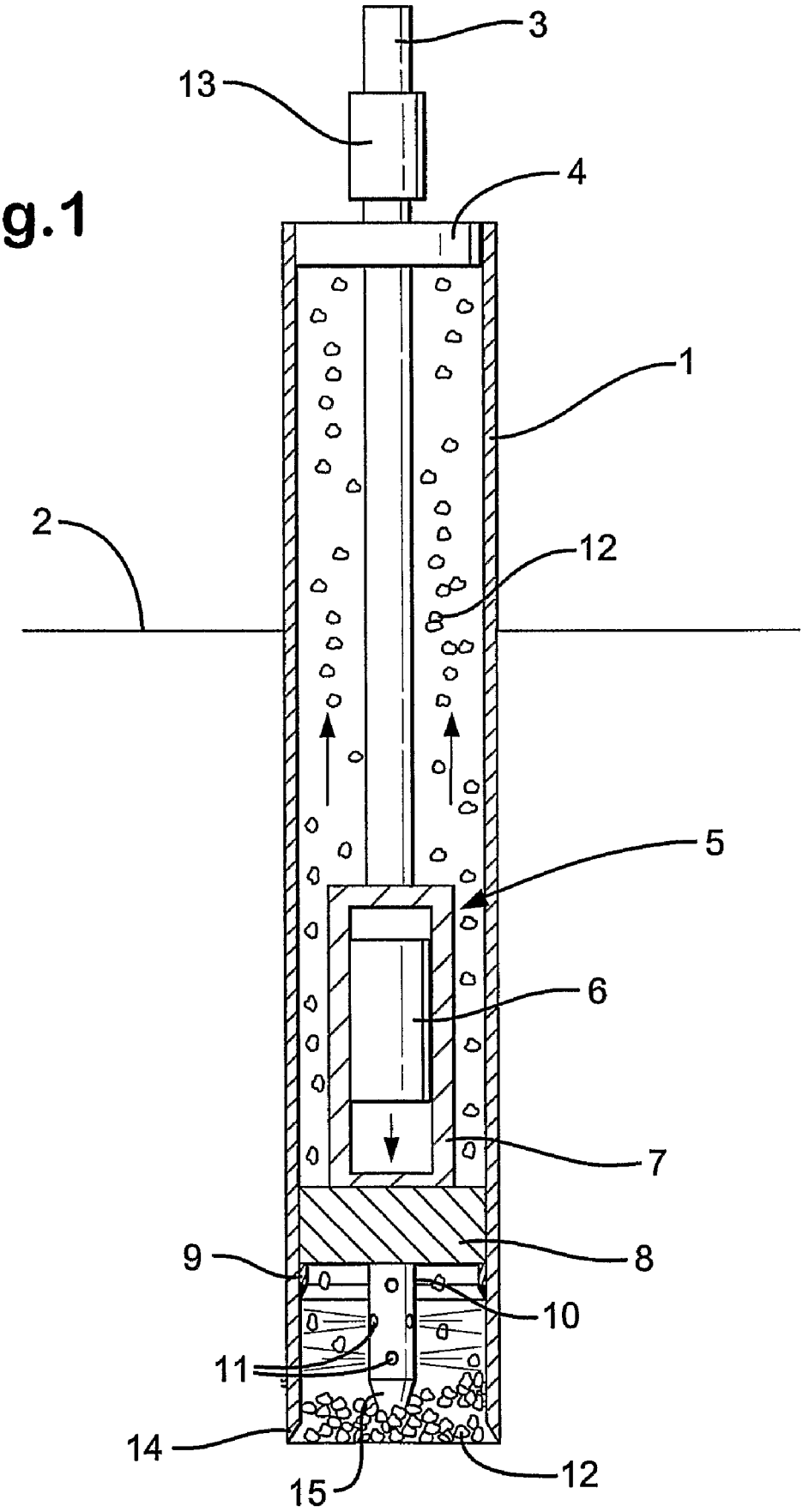
FIG. 1 is a schematic sectional representation of apparatus according to the present invention.

FIG. 1 shows an open-ended conductor pipe (1) partially driven into the seabed (2). The conductor pipe (1) is supported on a drill string (3) by means of a make-up tool (4). The lower edge (14) of the conductor pipe (1) is chamfered to assist penetration of the conductor pipe (1) into the soil. The reciprocal impact driving means (5) is also supported on the drill string (3) within the conductor pipe (1). The reciprocal impact driving means (5) comprises a hydraulically actuated hammer element (6) which can be moved within a housing (7).

Fluid is pumped down the drill string (3) by means of mud pumps (not shown) located on a drilling rig (not shown) to actuate the reciprocable impact driving means (5). The fluid lifts the hammer element (6) and then it is allowed to fall under the influence of gravity alone or assisted by the pumped fluid. The fluid used may conveniently be drilling mud and/or seawater. Suitable mechanisms to actuate and control the reciprocable impact driving means will be apparent to a person skilled in the art and may, for example, be similar to the known hydraulic hammers for hard rock drilling. Optionally, the pumped fluids may be used to drive mud motors that can be used to mechanically actuate the hammer element (6).

The housing (7) of the reciprocable impact driving means (5) is positioned on an anvil (8) which in turn rests on an internal shoulder (9) within the conductor pipe (1). When the hammer element (6) of the reciprocable impact driving means (5) falls, it strikes the bottom of the housing (7) transferring the percussive force of the reciprocable impact driving means (5) to the conductor pipe (1) via the anvil (8) and shoulder (9). The anvil (8) can be separate from or integral with the housing (7). The anvil (8) may be fixed to the conductor pipe (1).

Figure 2:
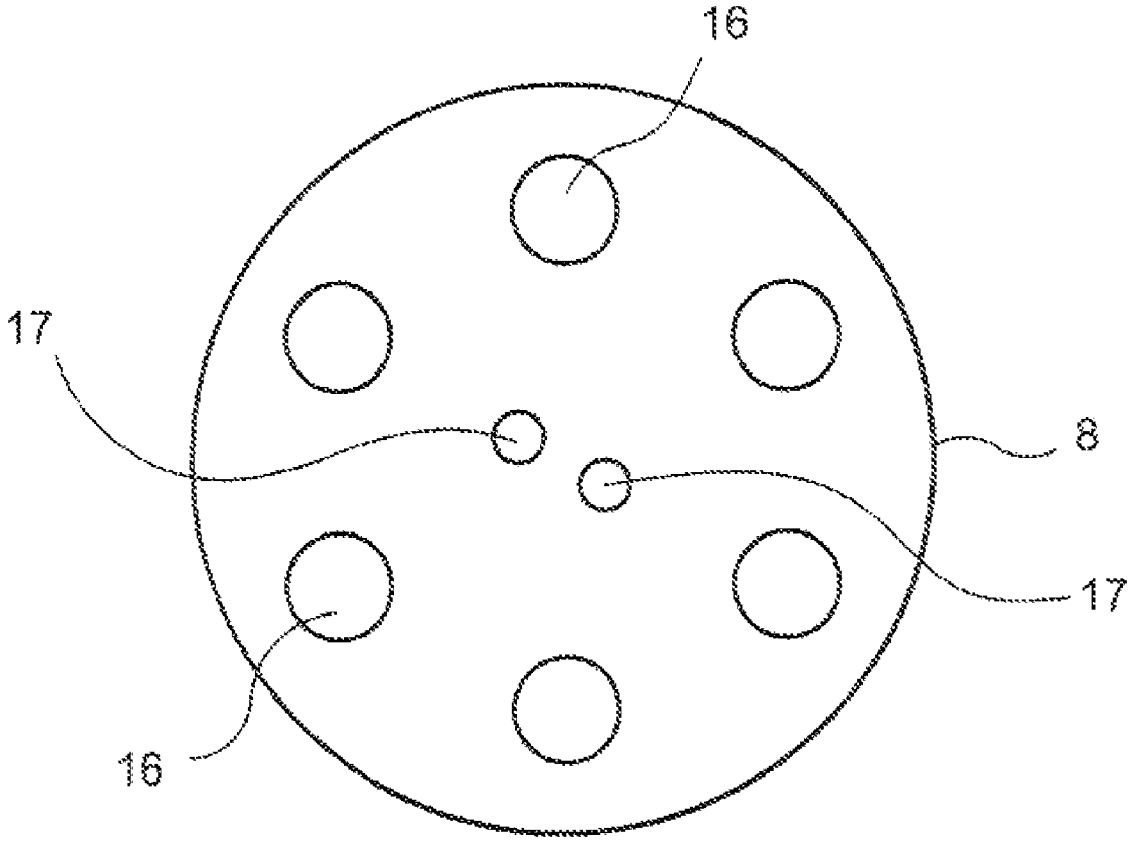
FIG. 2 is a top view of the anvil 8.

Below the anvil (8) and in fluid communication with the drill string (3) and/or the housing (7) of the reciprocable impact driving means (5), is a jetting sub (10). The jetting sub (10) comprises a tubular element with openings therein which allow pressurised fluid to be released into the bottom of the conductor tube (1) in the form of jets. The jets of fluid emerging from the openings (11) loosen the soil which has entered the bottom of the conductor pipe (1). The drilling cuttings (12) are entrained in the fluid and move upwardly through the annulus between the drill string and the conductor pipe (1) and are removed from the upper part of the conductor pipe (1). The equipment, including the makeup tool (4) and anvil (8) has passages (16), (17) (see FIG. 2) which allow the fluid and drill cuttings to pass through.

A shock absorber means (13) is included in the drill string above the make-up tool (4). Suitable shock absorbing means are known. The shock absorbing means reduces the forces transmitted to the drill string from the impact of the impact driving means (5) on the conductor pipe (1).

The fluid and associated drilling cuttings may be lifted to the surface and passed over a screen to separate the solids from the fluid. The fluid may then be reused.

In an alternative, and preferred embodiment, the fluid may be water or another environmentally acceptable fluid and the fluid and associated drill cuttings are simply allowed to overflow the conductor pipe (1) such that the solids settle around the outside of the conductor pipe (1). This arrangement may assist in the consolidation of the soil around the conductor pipe (1).

The bottom of the jetting sub (10) shown in the figure has a conical end 15 which assists with the penetration of the jetting sub into the soil.

The impact driving means (5) and the jetting means (10) can be used simultaneously or sequentially. It may, for example, be convenient to drive the conductor into the soil a short distance using the impact driving means (5), stop the reciprocation of the impact driving means (5) and then use the jetting sub (10) to loosen and remove the soil that has entered the bottom of the conductor pipe (1) before stopping the jetting and recommencing the reciprocation of the impact driving means (5).

The apparatus and method according to the present invention is likely to cause less damage to the surrounding soil as the conductor pipe is driven into the seabed. The open-ended conductor wall will cut into the seabed and, as the soil is removed from inside the conductor pipe, the disturbance to the surrounding soil is reduced as compared with known jetting techniques. This should result in the surrounding soil being able to provide immediate load bearing capacity, or at least significantly reducing the length of time that must be allowed to achieve sufficient consolidation of the surrounding soil.

The present invention can also provide the possibility of achieving greater setting depth. Since the soil within the conductor pipe is removed, the resistance to driving will only be the soil friction on the outside wall. This external wall friction can be further reduced by increasing surface smoothness, e.g. by the use of friction reducing paints or coatings. Where the conductor pipe comprises separate sections joined together, i.e. the conductor is a conductor string, they may conveniently be joined using external upset connectors. The use of external upset connectors or indeed external upsets which are not connectors on the external wall of the conductor can result in reduced soil friction, which can be particularly useful in relatively firm subterranean formations. Specially designed conductor connectors or other upsets which have a suitable external upset profile, e.g. a smooth profile, may also be used to reduce the soil friction around the conductor pipe body.

Modelling has shown that it will be possible to drive the conductor pipe to depths of at least 300 m based on the conditions found in typical Gulf of Mexico and other oil producing regions. The greater depth can further mitigate the problems associated with shallow hazards such as shallow water flow regions, hydrate layers and weak soil layers. Furthermore, if an even greater depth is required, e.g. in excess of 300 m, and the formation conditions allow, the apparatus and method of the present invention can be used in a multistage driving process in which a smaller diameter conductor pipe is lowered through an installed conductor pipe and the second is then driven in to the ground below the first. Thus, both a surface casing and an intermediate casing may be installed using the process of the present invention by driving a first surface conductor or conductor string into the ground and then installing through the first conductor or conductor string a second conductor or conductor string. The conductor pipe can comprise two or more lengths of pipe, each successive length being of a smaller diameter than the preceding pipe so that it can be passed through the preceding pipe to the location of installation. The lengths of pipe can be of the same or different wall thickness.

The greater load carrying capacity of the conductor pipe that can be achieved using the apparatus and method of the present invention may obviate the need for a conductor liner on some deepwater wells. This would provide a significant cost saving.

The invention claimed is:

1. An apparatus for driving an open-ended conductor pipe into the ground comprising in combination:

an open-ended conductor pipe capable of being driven into the ground, a drill string, a means for pumping fluid through the drill string, a means for supporting the conductor pipe on the drill string, a reciprocable impact driving means supportable by the drill string within the conductor pipe, a means for reciprocating the reciprocable impact driving means using fluid pumped through the drill string, an anvil capable of transferring the percussive force of the reciprocable impact driving means to the conductor pipe; and a means for jetting fluid into the lower portion of the conductor pipe.

2. An apparatus as claimed in claim 1, further comprising shock absorbing means for reducing the percussive force transmitted between the conductor pipe and the drill string.

3. An apparatus as claimed in claim 1, wherein the conductor pipe has an internal shoulder engageable with the anvil.

4. An apparatus as claimed in claim 1, wherein the means for jetting fluid into the lower portion of the conductor pipe comprises a tubular element in fluid communication with either or both of the drill string and the reciprocal impact driving means; the tubular element having openings through which relatively high pressure fluid can pass into the lower portion of the conductor pipe.

5. An apparatus as claimed in claim 1, wherein means are provided for breaking up the soil disturbed by the means for jetting fluid.

6. An apparatus as claimed in claim 1, wherein the conductor pipe comprises two or more lengths of pipe, each successive length being of a smaller diameter than the preceding pipe.

7. An apparatus as claimed in claim 6, wherein the conductor pipes are of different wall thickness.

8. A method for driving open-ended conductor pipe into the ground comprising:

assembling at the lower end of a drill string means for supporting an open-ended conductor pipe on the drill string, a reciprocable impact driving means, means for reciprocating the reciprocable impact driving means using fluid pumped through the drill string, an anvil capable of transferring the percussive force of the reciprocable impact driving means to the conductor pipe and means for jetting fluid, positioning the assembly within a conductor pipe such that the assembly and conductor pipe are supportable by the drill string and the means for jetting fluid is at the lower end of the conductor pipe, positioning the lower end of the conductor pipe on the ground into which it is to be driven, actuating the reciprocable impact driving means to impact the anvil and drive the conductor pipe into the ground, simultaneously or sequentially jetting fluid into the lower part of the conductor pipe such that it flows upwardly carrying with it particles that have been forced into the conductor pipe the fluid and particles being removed from the upper part of the conductor pipe.

9. A method as claimed in claim 8, wherein the particles removed from the upper part of the conductor pipe overflow the conductor pipe and settle around the outside of the conductor pipe.

10. A method as claimed in claim 8, wherein a first surface conductor pipe is driven into the ground and subsequently a second conductor pipe of smaller diameter is lowered through the first conductor pipe and the second is then driven into the ground below the first conductor pipe.

11. A downhole assembly comprising, attached at the lower end of a drill string means for supporting an open-ended conductor pipe on the drill string, a reciprocable impact driving means, means for reciprocating the reciprocable impact driving means using fluid pumped through the drill string, an anvil capable of transferring the percussive force of the reciprocable impact driving means to the conductor pipe and means for jetting fluid.

* * * * *